United States Patent [19]

Gladwin

[11] 4,124,058

[45] Nov. 7, 1978

[54] SIDE WALL GUIDE FOR ADJUSTABLE WIDTH CONTINUOUS CASTING MOLD

[76] Inventor: Floyd R. Gladwin, 21000 E. River Rd., Gross Ile, Mich. 48138

[21] Appl. No.: 821,074

[22] Filed: Aug. 2, 1977

[51] Int. Cl.[2] ..... B22D 11/04; B28B 7/02

[52] U.S. Cl. ..... 164/436

[58] Field of Search ..... 164/444, 436, 425, 418, 164/82, 297, 441, 442, 381, 385, 388, 389, 390; 249/158

[56] References Cited

U.S. PATENT DOCUMENTS

| | | | |
|---|---|---|---|
| 3,736,977 | 6/1973 | Stockinger | 164/82 X |
| 3,957,105 | 5/1976 | Foye | 164/82 X |
| 3,964,727 | 6/1976 | Gladwin | 164/436 X |

*Primary Examiner*—Francis S. Husar
*Assistant Examiner*—John S. Brown
*Attorney, Agent, or Firm*—Cullen, Sloman, Cantor, Grauer, Scott & Rutherford

[57] ABSTRACT

A continuous casting mold formed of a front wall, a spaced rear wall and side wall members extending between said walls to form an upwardly and downwardly opening, roughly rectangular in cross section casting cavity. The side wall members are moveable towards and away from each other to adjust the width of the casting cavity. The side walls members are formed of interior face plates having side edges which are perpendicular to and in face-to-face contact with their adjacent front and rear wall surfaces, and backing plates having side edges spaced a short distance away from the front and rear wall surfaces. Mounted upon the backing plate side edges are guide blocks, each having an exposed surface co-planar with the edge surface of its adjacent face plate edge for guiding and positioning the side wall members against tilting relative to the front and rear wall interior surfaces. Thus, the guide blocks prevent the side edge walls from turning out of full contact with, and thereby forming a flash-producing gap relative to the front end rear interior surfaces.

3 Claims, 12 Drawing Figures

SIDE WALL GUIDE FOR ADJUSTABLE WIDTH CONTINUOUS CASTING MOLD

BACKGROUND OF INVENTION

The invention herein relates to a guide block or pad for the side wall members of an adjustable width continuous casting mold of the type disclosed and illustrated in my prior U.S. Pat. No. 3,964,727 issued June 22, 1976. Such continuous casting molds are used in the casting process of forming continuous slabs from molten metal.

The casting mold itself is a box-like container or frame having an open upper and lower end to form a casting cavity. Molten metal is poured into the upper open end and is partially cooled within the cavity so as to form a solidified skin surrounding an interior core of molten metal. The skin and core together form a continuous, extrusion like slab which emerges from the open lower end of the mold.

In such type casting, the continuous slab may remain in approximately vertical position below the mold or it may be bent or turned into a horizontal direction for cutting and processing. My prior U.S. Pat. No. 3,978,910 issued Sept. 7, 1976, describes a side wall member cooling system wherein the interior walls forming the cavity of the mold are curved slightly from a vertical to a horizontal direction. As the slab is formed in the mold, it begins to curve away from the vertical. As it is further cooled beneath the mold, while supported upon rollers, the slab is guided to curve 90° from the vertical, i.e., into horizontal direction.

The mold front and rear interior mold surfaces are either flat and vertical for vertical slab formation, or curved for bending the slab horizontally. Thus, the mold side wall members, which are clamped between front and rear wall members of the continuous casting mold may have their side edges either straight or curved to contact and closely fit between either the flat or the curved interior surfaces of the mold walls. In either event, the side wall members are preferably perpendicular to the front and rear wall members. Such side walls members are formed of interior face plates made of copper or copper-like material which are supported by back plates. The face plates are appropriately grooved or channeled to receive cooling water which is flowed into and out of the channels through openings or pockets formed in the backing plates. Each backing plate normally is of a slightly smaller size than the face plate so that its edges are gapped or spaced away from the front and rear interior wall surfaces of the mold.

In the mold described above, as further described in my U.S. Pat. No. 3,964,727 mentioned above, the side wall members are supported upon mounting blocks so that they may be adjusted inwardly towards each other or outwardly away from each other by adjusting the longitudinal movement of support shafts carried by the blocks. The mounting blocks also are provided with bolts, to support them to the front and rear walls of the mold, and plungers or separaters to separate the mold walls against a spring pressure, to loosen the side wall members for adjustment when desired.

During adjustment of the side wall members, where the front and rear walls of the mold are held apart sufficiently to unclamp the side wall members, it has been found that the movement of the side wall members sometimes results in them cocking or tilting out of perpendicular relative to the interior surfaces of the front and rear walls, with the result that when the walls are released for reclamping the side wall members between them, a misalignment of the side wall members sometimes occurs. This produces a gap or space between one side edge and its adjacent front or rear wall surface, which receives molten metal and forms a flash along one corner of the slab. Such a flash causes the slab to resist moving through the mold and may tear or break or form a weaker spot in the fragile, thin slab skin to permit the molden metal core to break out.

Thus, the invention herein is concerned with the problem of maintaining the side wall members in proper alignment with the interior wall surfaces of the front and rear walls of the mold to prevent flash forming wall gaps in the mold corners.

SUMMARY OF INVENTION

The invention herein relates to providing pads or guide blocks on the steel backing plates which support the copper interior face plates of the side wall members of a continuous casting mold of the type having adjustable side wall members. More specifically, small size pads or blocks are mounted within sockets formed in the edges of the steel backing plates. The pads or blocks are provided with exposed guide surfaces formed with a curvature which parallels the curvature of the adjacent curved edge of the side wall face plate and is either co-planar with that side edge or spaced a very slight distance inwardly of the side edge. Thus, the guide surfaces of the guide blocks cooperate with the adjacent portions of the interior surfaces of the front and rear walls of the mold as if there were a physical guide moving along a physical rail to prevent cocking or tilting of the side wall members relative to the front and rear wall interior surfaces.

Thus, an object of this invention is to prevent slab corner flash formation, by providing a simplified and inexpensive guide system to prevent cocking or twisting of the side wall members during adjustment of the mold width, which system in essence comprises a simplified block having an exposed guide surface bearing against a corresponding horizontal stripe or line along the interior surface of the adjacent front or rear wall of the mold.

These and other objects and advantages of this invention will become apparent upon reading the following description, of which the attached drawings form a part.

DETAILED DESCRIPTION

Figures 1, 2, 3, 4, 5, 6, 7, 8, 9, 10, 11, 12:
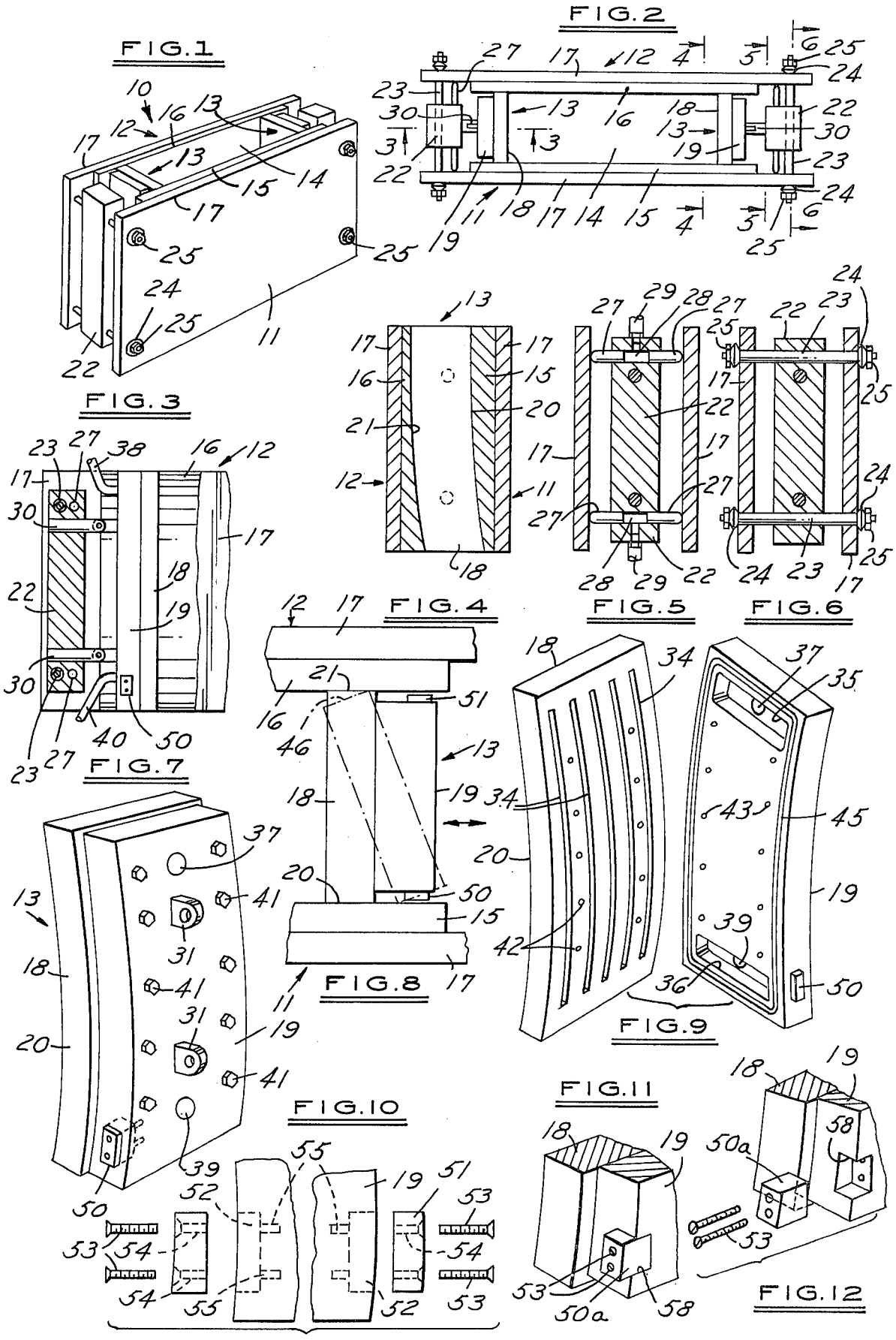
FIG. 1 is a perspective view of a continuous casting mold.
FIG. 2 is a top plan view of the mold.
FIG. 3 is a fragmentary, elevational view, taken in the direction of arrows 3—3 of FIG. 2.
FIG. 4 is a cross sectional view taken in the direction of arrows 4—4 of FIG. 2.
FIG. 5 is a cross sectional view taken in the direction of arrows 5—5 of FIG. 2.
FIG. 6 is a cross sectional view taken in the direction of arrows 6—6 of FIG. 2.
FIG. 7 is an enlarged perspective view of a side wall member.
FIG. 8 is an enlarged, top plan view, showing a fragmentary portion of the mold front and rear walls and side wall member.
FIG. 9 is a prespective view showing the interior face plate and exterior backing plate of the side wall member, with the two plates swung apart.
FIG. 10 is an enlarged, fragmentary view, showing the guide blocks and mounting sockets disassembled.
FIG. 11 is a perspective view of a modified guide block shown on a fragment of the mold side wall member.
FIG. 12 is a perspective, disassembled view of the modified guide block and its socket.

The continuous mold 10 is similar to the mold described and illustrated in my prior U.S. Pat. No. 3,964,727 issued June 22, 1976. Such mold comprises a front wall 11, a rear wall 12, and side wall members 13 clamped between the front and rear walls to form a vertical casting cavity 14 which is approximately rectangular in cross section. Molten metal is poured into the open upper end of the cavity 14 and solidified metal in the form of a rectangular shaped slab comprising a solidified skin enclosing molten metal, emerges from the open lower end of the mold.

In this type of mold, the slab will begin changing from the vertical direction towards a horizontal direction. Thus, the front wall interior sheathing or copper face plate 15 and the rear wall sheathing or copper face plate 16 are each formed with opposing, parallel, curved surfaces. These surfaces are scribed to a large radius, i.e., 10 to 50 feet, by way of example, along a horizontal axis, as shown in FIG. 4 so that the curve is in the vertical direction.

The copper or copper-like sheathing or face plates are mounted upon steel back plates 17 to make up the respective front and side walls. The sheathing or face plates are centered relative to their respective back plates and are of a lesser length than the back plates.

The side wall members 13 are each formed of an interior face plate 18 made of copper or copper-like material mounted upon an exterior steel backing plate 19. The face plate is formed with a concave edge 20 and an opposite convex edge 21 of a curvature to closely match the corresponding curvature of the interior wall of the face plates 15 and 16 respectively.

The side wall members are carried by mounting blocks 22 which are supported upon transverse bolts 23 extending through aligned openings in the front and rear wall back plates 17 and the block (See FIG. 6). Such bolts 23 are provided with heavy duty spring washers or springs 24 and nuts 25. Thus, the bolts serve to force the front and rear walls towards each other to clamp the side wall members therebetween.

In order to adjust the location of the side wall members, the mounting blocks are provided with transverse plungers 27 arranged within cylinders 28 connected to a source of pressurized fluid through a connection pipe 29 (See FIG. 5). Thus, the fluid pressure in the cylinders causes the plungers 27 to move outwardly relative to each pair of plungers and bear against the back plates 17 of the side walls to force them apart sufficiently to loosen the clamping force on the side wall members.

The mounting blocks are provided with shafts 30 which reciprocate endwise and connect to brackets 31 on the backing plates 20 by means of suitable pins or connectors. Mechanical means are provided to move the shafts 30 towards and away from the interior of the mold to thereby correspondingly move the side wall members towards and away from each other. The particular means may be varied. A suitable means for moving such shafts is shown in my prior U.S. Pat. No. 3,964,727 and since it forms no part of the invention herein, is not further disclosed here.

As shown in FIG. 9, the interior face plates 18 of the side wall members are each provided with channels 34 through which water may be circulated for cooling. The upper and lower ends of the channels are overlapped by pockets 35 and 36 respectively formed in the steel back plate 19. An inlet hole 37 in the upper pocket 35 is provided with an inlet pipe 38 for receiving water which thus flows through the respective channels and then out through the lower pocket 36 and out of an outlet hole 39 and an outlet pipe 40.

The face plate 18 is secured to its back plate 19 by means of suitable bolts 41 extending through bolt holes 42 and aligned bolt holes 43 in the plate 18 and back plate 19 respectively. Also, a seal strip 45, preferably arranged within a groove formed in the steel back plate 19, serves to seal the two plates together. The construction of the cooling system is disclosed in more detail in my prior U.S. Pat. No. 3,978,910 mentioned above.

The backing plate 19 is of a slightly smaller exterior dimension than the copper sheath or face plate 18. Thus, when the side walls are separated by means of the operation of the plungers 27, and the side wall members are moved, and reclamped, there is a tendency for the side wall members to cock or twist relative to the front and rear walls as illustrated by the dotted lines, FIG. 8, to form a gap or space 4–6 along one vertical corner. Molten metal flowing into that gap forms a corner flashing on the slab. To prevent that, the gap must be avoided. To keep the side wall members perpendicular to the front and rear walls while moving and upon reclamping the respective parts, and thereby avoiding the gaps, a convex surfaced guide pad or block 50 and a concave surfaced guide pad or block 51 is secured to the lower edge portion of each of the steel back plates 19. The pads or blocks are fitted within sockets 52 and secured therein by machine screws 53 extending through screw holes 54 into the blocks and receiving screw holes 55 in the sockets.

The sockets and the blocks are made to a high degree of accuracy and the concave and convex surfaces of the blocks are curved, to a high degree of precision, to the same curvature as the corresponding edges 20 and 21 of the face plates 18 which means the corresponding curvature of the interior surfaces of sheathing or face plates 15 and 16 of the front and rear walls.

The curved surfaces of the pads or blocks are either co-planar with the adjacent curved surfaces 20 and 21 of the edges of the copper face plates 18 or alternatively are slightly inwardly of the plane of such curved surfaces, as for example, about two thousandths of an inch. Thus, the blocks cooperate with or closely track a horizontal stripe or line or section of their adjacent curved interior side walls as if there were a physical connection between a guide and a rail. That cooperation tends to keep the side wall members moving horizontally, that is, in proper perpendicular alignment relative to the front and rear walls to avoid cocking or twisting of the side wall members relative to the mold walls.

The blocks 50 and 51 shown in FIGS. 7, 8 and 10 are arranged within sockets that completely surround the sides and interior or bottom face of the blocks. However, such blocks may be mounted within corner sockets, as shown in FIGS. 11 and 12 wherein two faces are exposed, namely the curved guide or block face of the block or pad 50*a*. The corner sockets 58, may be somewhat easier to construct in some molds.

Although the molds are made in a wide variety of sizes, for illustrative purposes, the dimensions of the mold described herein may be roughly in the order of a cavity which is about 8 inches wide (i.e., along the width of the side members) and 50 inches long, and 25–40 inches high. In such case the side mold member face plate may be roughly 1½ inches thick with the backing plate 2½ inches thick. The guide blocks may be roughly 2 inches high, by 1 inch by 1 inch. Also, their guide surfaces are flat, where the interior surfaces of the front and rear walls are flat.

I claim:

1. In an adjustable width continuous casting mold formed of a pair of opposing spaced apart, parallel, front and rear mold walls and a pair of spaced apart side wall forming members perpendicularly arranged between the mold walls to form a roughly rectangular in cross-section, tubular, open upper and lower end casting cavity, and with the side wall members each being formed of an interior face plate and an exterior backing plate, with the opposite upright side edges of each face plate being curved parallel to and in face-to-face line contact with its adjacent mold wall surface and with the opposite side edges of the backing plates, each being spaced inwardly from its respective adjacent mold wall surface, and means for adjusting the position of each side wall member towards and away from each other in a horizontal direction for thereby adjusting the width of the casting cavity, the improvement comprising:

opposed sockets formed in a side edge of each backing plate, with the sockets opening towards their respective mold wall interior surfaces;

a narrow guide block secured within each socket, with each block having an exposed guide face corresponding to and being arranged to closely track a portion of its adjacent mold wall interior surface while its side wall member is moved for adjustment, so as to contact the mold wall interior surface and thereby hold its side wall member against twisting movement out of perpendicularity relative to the mold walls, to avoid flash producing gaps forming at the junctures of the side wall members and the mold wall interior surfaces;

and each block guide face being normally spaced a slight distance inwardly of its adjacent mold wall interior surface when the side wall member face plate edges are in contact with same and the side wall is perpendicularly arranged relative to the mold walls;

and the block guide faces being formed to normally contact their respective mold wall surfaces only when the side wall members twist slightly out of perpendicularity wherein the blocks prevent such further twisting movement.

2. A construction as defined in claim 1, and said sockets each being formed to completely receive its respective block on all sides of said block, except for the block exposed guide face and the immediate portions of the block extending across the space between its respective backing plate side edge and adjacent wall interior surface.

3. A construction as defined in claim 1 and said sockets each being formed on their respective backing plate side edge corners which are remote from the face plate of the respective backing plate and the sockets being open towards the adjacent mold wall and also exteriorly relative to the face plate of the side wall member so that a portion of the guide block is exposed outwardly of the mold.

* * * * *